US012285668B1

(12) United States Patent
Grigoryan et al.

(10) Patent No.: US 12,285,668 B1
(45) Date of Patent: Apr. 29, 2025

(54) BALL GAME KIT AND METHOD OF PLAYING IT, ENTITLED BEACH SNIPER

(71) Applicant: Vahe Grigoryan, La Crescenta, CA (US)

(72) Inventors: Vahe Grigoryan, La Crescenta, CA (US); Vardan Grigoryan, La Crescenta, CA (US)

( * ) Notice: Subject to any disclaimer, the term of this patent is extended or adjusted under 35 U.S.C. 154(b) by 0 days.

(21) Appl. No.: 18/926,199

(22) Filed: Oct. 24, 2024

(51) Int. Cl.
*A63B 67/00* (2006.01)
*A63B 71/02* (2006.01)
*A63B 71/06* (2006.01)

(52) U.S. Cl.
CPC ..... *A63B 67/002* (2013.01); *A63B 71/021* (2013.01); *A63B 71/0669* (2013.01); *A63B 2071/024* (2013.01); *A63B 2208/0204* (2013.01)

(58) Field of Classification Search
CPC . A63B 69/002; A63B 71/021; A63B 71/0669; A63B 2071/024; A63B 2208/0204
See application file for complete search history.

(56) References Cited

U.S. PATENT DOCUMENTS

2006/0189417 A1* 8/2006 Evans ..... A63B 69/0079 473/446
2010/0087296 A1* 4/2010 Hansen ..... A63B 69/222 434/258
2018/0071607 A1* 3/2018 Alexander ..... A63B 69/38

FOREIGN PATENT DOCUMENTS

DE 102012205422 A1 * 10/2013 ..... A63B 43/007
WO WO-2005037381 A1 * 4/2005 ..... A63B 69/002

* cited by examiner

*Primary Examiner* — Raleigh W Chiu
(74) *Attorney, Agent, or Firm* — Phil IP Law Inc.; Karen Kirk Galoyan; Narek Zohrabyan

(57) ABSTRACT

A Beach Sniper game kit and method for playing by multiple teams are provided. The kit includes a target ball with a hook, a target ball support with a conical frustum, strike and pitch balls, elastic ropes, and ropes forming triangular playing areas. A digital counter tracks the scores. The game involves positioning players in specific locations within and outside the triangles. Teams alternate between pitching/receiving and striking roles. The pitching team tosses the ball between teammates for points, while the opposing team attempts to strike the ball mid-air for higher points. Players rotate positions after predetermined rounds. The game continues with team position switches and role reversals. Scoring is tracked digitally after each round. The winner of a set is determined after a preset number of rounds, with tiebreakers as needed. The team winning a predetermined number of sets wins the game.

18 Claims, 6 Drawing Sheets

BALL GAME KIT AND METHOD OF PLAYING IT, ENTITLED BEACH SNIPER

BACKGROUND

The disclosure here relates to the field of games, in particular, to a game using a ball.

Outdoor games have long been a popular form of entertainment at social gatherings, parties, and recreational events. These games provide a means for people to engage in physical activity, socialize, and enjoy the outdoors. Many such games are designed to be accessible to participants of various ages and skill levels, making them ideal for diverse group settings.

Among the wide array of outdoor party games, those involving physical objects or equipment have gained particular prominence. These games often require minimal setup and can be easily learned, allowing for quick engagement and enjoyment. Examples include games involving targets (such as horseshoes or cornhole), games with handheld implements (like badminton or croquet), and various types of races or relay games.

Ball games represent a significant subset of outdoor party games, offering versatility in terms of play style and required skills. Balls are portable, easy to use, and can facilitate a range of activities from simple catch to more complex team sports. Traditional ball games played at outdoor gatherings include volleyball, soccer, and various forms of catch or keep-away.

SUMMARY

In accordance with an aspect, there is provided the Beach Sniper game kit and the method of playing beach sniper game by a plurality of teams with the ultimate goal of winning the beach sniper game. The Beach Sniper game kit may include a target ball, a target ball support, at least one strike ball, at least one pitch ball, at least one elastic rope and at least two rope. The at least two rope may be folded into a shape of triangles, where the base vertices of the triangles may be shaped into loops using at least one clamp, and wherein each of the at least one clamp may be attached at a sufficient distance from the base vertices, thereby creating loops large enough to accommodate one of the plurality of anchors. Each loop of the triangle may accommodate an anchor. The vertex angle of the triangle may be less than 90 degrees. Each end of the at least one elastic rope may be coupled to loose ends of each of the at least two rope using at least one clamp, wherein the length of the at least one elastic rope may be adjustable based on the level of elasticity of the at least one rope. The target ball support may be positioned in a predetermined position that may bisect the at least one elastic rope, and the target ball support may have a hollow conical frustum which may be positioned on the base. The base of the target ball support may have a shape of the square which in turn may have holes located in each of the four corners, wherein each hole may accommodate one of the plurality of anchors. The passing channel may be located on top of the conical frustum through which at least one elastic rope may pass. The target ball may have a hook attached to its outer surface.

The beach sniper game may also have a digital counter, which may have a first button with a first color corresponding to a starting team and may have a second button with a second color corresponding to the opposing team. The digital counter may also have a first score window which may be configured to display points for the starting team when the first button is pressed. The digital counter may also have a second score window configured to display points for the opposing team when the second button is pressed. The digital counter may also have a first game score window which may be configured to display the overall game points for the starting team and a second score window which may be configured to display the overall game points for the opposing team.

The method of playing a beach sniper game by a plurality of teams, with the ultimate goal of winning the beach sniper game may include the steps of positioning the beach sniper game upon a playing surface which in its turn may include steps of laying on the playing surface two triangles. Two triangles may be positioned on opposite sides from one another, wherein the two triangle may be coupled together through at least one elastic rope with the use of at least one clamp. The target ball support may be set in between the two triangles at the bisection of the at least one elastic rope. The next step may include attaching each of two triangles to the playing surface using one of the plurality of anchors which may be passing through each loop fashioned into the base vertices of each of the respective two triangles. Furthermore, steps may include attaching the target ball support to the playing surface by using one of the plurality of anchors, wherein the latter may pass through each hole located on a corner of a base of the target ball support. The next step may be situating a target ball on the target ball support in a way that a hook of the target ball may be positioned inside a conical frustum of the target ball support. The hook may come into contact and may be retained by the at least one elastic rope.

The steps of determining which team starts the game first may include positioning one player from each team at a pitcher's position. The pitcher's position may be located near a midpoint of a respective base of each of the two triangles, and the pitcher's position may be situated outside the perimeter of its corresponding each of the two triangles. Each player located at the pitcher's position may be given an attempt to hit the target ball with their respective pitch ball or strike ball without crossing or touching the base of one of the two triangles. If any player crosses or touches the base of one of the two triangle, no successful hit are going to be recorded and the other player may take the attempt. The team with the first successful hit may be declared as a starting team and the other team may be declared as an opposing team. When the score is a tie, each player may continue with additional single attempts until one team hits the target ball, while the other misses. The next step of playing beach sniper game may be positioning a first player of the starting team at the pitcher's position of one of the two triangles and positioning a second player of the starting team at a receiver's position in the other of the two triangles. The receiver's position may be located within the perimeter of the respective triangle. The first player of the starting team may toss the pitch ball to the second player of the starting team. The first player of the starting team may not cross or touch the base of one of the two triangles. The one point may be awarded to the starting team if the second player of the starting team successfully catches the pitch ball while remaining at the receiver's position. The score may be recorded after each round using a digital counter. The first player of the opposing team may be positioned within a second region, wherein one foot positioned on a second strike base while a strike ball at hand. The second player of the opposing team may be positioned within a first region where a first strike base is located. The first player of an opposing team may have an attempt to strike the tossed pitch ball, in mid-air, with a strike ball but only after the first player of the opposing team signaled his readiness to the first player of the starting team. At least one point may be awarded to the opposing team if the first player of the opposing team successfully strikes the pitch ball in the mid-air. The at least one point may be awarded to the opposing team when the second player of the opposing team catches the strike ball in mid-air, when the first player of the opposing team does not strike the pitch ball in mid-air. The tossing and striking attempts may be repeated for a predetermined number of rounds. The scores may be recorded using the digital counter after each round.

After completing the predetermined number of rounds the next steps may include switching the players' positions, wherein the first player of the starting team may move from the pitcher's position to the receiver's position within the same one of the two triangles. The second player of the starting team may move from the receiver's position to the pitcher's position within the same one of the two triangles. The second player of the opposing team may be positioned within the first region with the strike ball at hand, wherein one foot of the first player of the opposing team may be positioned on the first strike base, while the first player of the opposing team may be positioned within the second region where the second strike base is located. The game may be continued to be played for a predetermined number of rounds in opposite direction, where the second player of the starting team may toss the pitch ball to the first player of the starting team, and the second player of the opposing team may attempt to strike the tossed pitch ball. The score may be recorded using the digital counter. The starting team's positions may be switched with the opposing team's positions and the game may continue to play for a predetermined number of rounds. After each round the scores may be recorded using the digital counter. The winner of the set may be determined after playing a predetermined number of rounds. If the score is a tie, the steps of determining which teams first starts to play may be repeated, until one team scores more points and then declared the winner. The game is won by the team which may first win a predetermined number of sets.

DESCRIPTION OF THE DRAWINGS

Embodiments in accordance with the present invention are shown in the drawings and will be described below with reference to the figures, whereby elements having the same effect have been provided with the same reference numerals.

The following is shown.

Figure 1A:
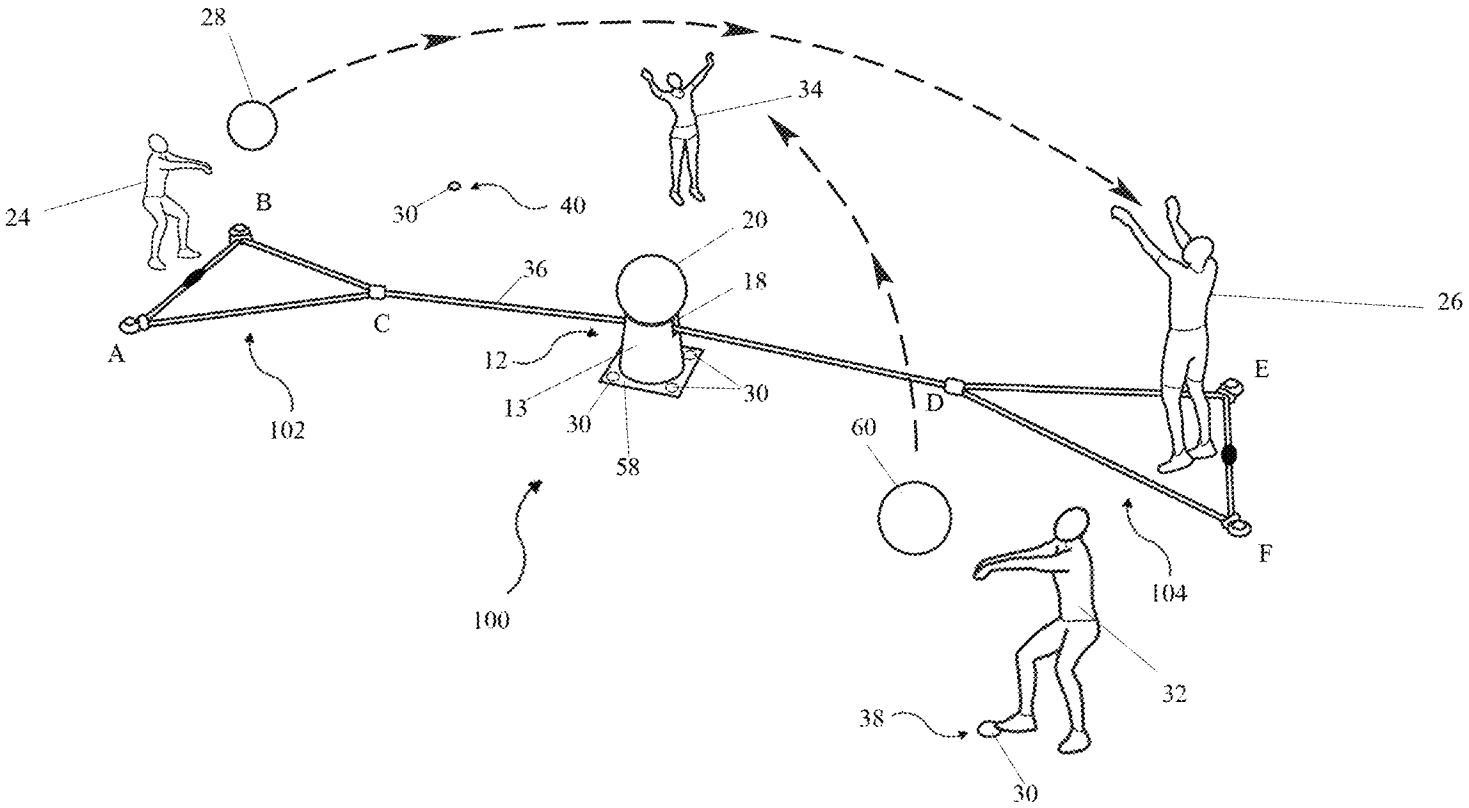
FIG. 1A shows an elevated right perspective view of an embodiment of the Beach Sniper game kit.

To facilitate a comprehensive understanding of the Beach Sniper Game Kit, the following list is not limited but enumerates the reference numerals used throughout the description and drawings.

The list is as follows:

1. Beach Sniper game kit 100
2. Left field 102
3. Right field 104
4. Elastic rope 36
5. Target ball 20
6. Target ball support 12
7. Pitch ball 28
8. Strike ball 60
9. First strike base 40
10. Second strike base 38
11. Plurality of anchors 30
12. Hook 22
13. Rope 2
14. Loop 4
15. At least one clamp 6
16. Midpoint 8
17. Midpoint 10
18. Square base 58
19. Plurality of holes 14
20. Hollow conical frustum 13
21. Passing channel 18
22. Digital counter 42
23. Blue button 44
24. Red button 46
25. Blue score window 48
26. Red score window 50
27. Blue game score window 52
28. Red game score window 54 30. Strap 56
29. Strap 56
30. Midpoint 16

DESCRIPTION

Exemplified embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

FIG. 1A exemplifies an elevated right perspective view of an embodiment of the Beach Sniper game kit 100. The Beach Sniper game kit 100 incorporates a left field 102, a right field 104, elastic rope 36, target ball 20, target ball support 12, pitch ball 28, a strike ball 60, first strike base 40, and a second strike base 38.

Figure 1B:
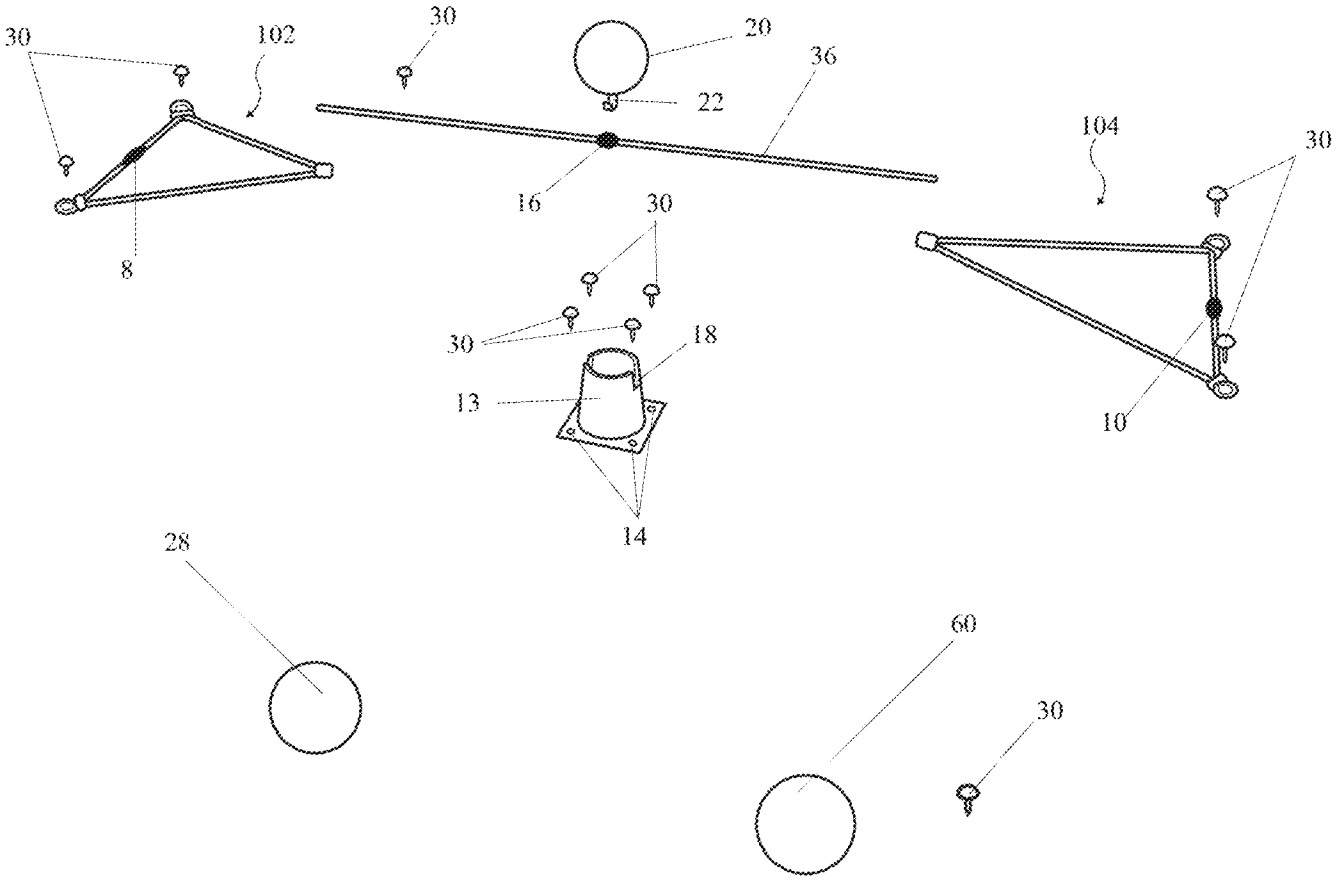
FIG. 1B shows an exploded view of an embodiment of the Beach Sniper game kit.

FIG. 1B exemplifies an exploded view of an embodiment of the Beach Sniper game kit 100. The Beach Sniper game kit 100 incorporates a plurality of anchors 30, a target ball 20 having a hook 22 attached to the bottom part of the target ball 20.

Figure 2:
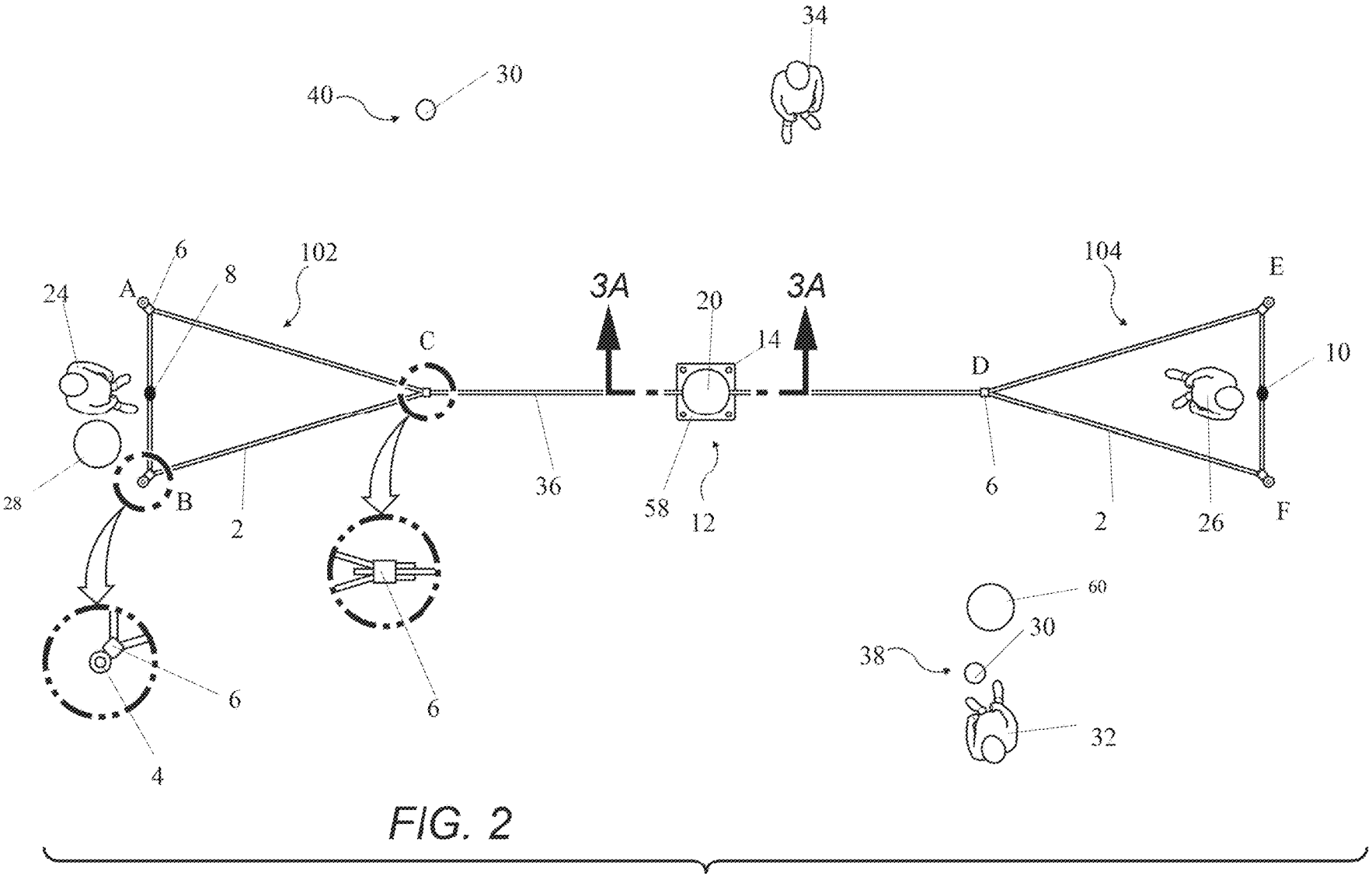
FIG. 2 shows a top view of an embodiment of the Beach Sniper game kit.
Figure 3:
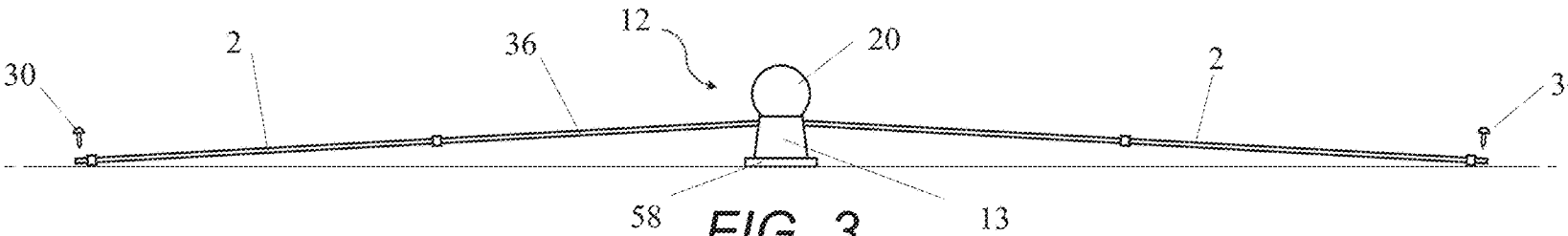
FIG. 3 shows a side view of an embodiment of the Beach Sniper game kit.

FIG. 2 exemplifies a top view of a Beach Sniper game kit 100. The elastic rope 36 is connected at one end to the left field 102 and on the other end to the right field 104. The elastic rope 36 is made of rubber, or any other suitable elastic material. Elastic rope 36 may also be made of a conventional rope. Each field 102 and 104 incorporates at least one rope 2, wherein each rope 2 are folded in such a way as to form identical isosceles triangles ABC and DEF. In triangle ABC, two equal sides AC and BC form a triangle with base AB. Similarly, triangle DEF has two equal sides DE and DF with base EF. In other embodiments, each field 102 and 104, may take a form of different types of triangles or other geometrical shapes, such as rectangles, circles, hexagons, or any other suitable polygonal or curved forms not limited by these examples.

In triangle ABC, at each of base vertices A and B, the rope 2 is structured with use of at least one clamp 6 in such a way as to form a loop 4 which serves as an anchor point whereby through the loop 4 passes the one of the plurality anchors 30. The diameter of loop 4 is specifically designed to be large enough to accommodate one of the plurality of anchors 30. This diameter is constrained by attaching at least one clamp 6 to rope 2 at a distance sufficiently away from the respective vertices A or B. This ensures the appropriate size of the loop 4 to allow secure passage of the anchor 30. In triangle ABC, the two loose ends of the rope 2 at vertex C are connected with an elastic rope 36 using at least one clamp 6. The vertex angle C is less than 90 degrees-acute angle. In other embodiments the vertex angle C may be 90 degrees (right angle) or more than 90 degrees (obtuse). One end of the elastic rope 36 is positioned between the two loose ends of rope 2, effectively joining the two loose ends of rope 2 together with the elastic rope 36. The base AB of the triangle ABC is secured to the ground by attaching two loop 4 corresponding to vertices A and B to predetermined positions, using one of a plurality of anchors 30 per loop 4, as shown in FIG. 1A.

In triangle DEF, at each of base vertices E and F, the rope 2 is structured with use of at least one clamp 6 in such a way as to form a loop 4 which serves as an anchor point whereby through the loop 4 passes the one of the plurality anchors 30. The diameter of loop 4 is specifically designed to be large enough to accommodate one of the plurality of anchors 30. This diameter is constrained by attaching at least one clamp 6 to rope 2 at a distance sufficiently away from the respective vertices A or B. This ensures the appropriate size of the loop 4 to allow secure passage of the anchor 30. In triangle DEF, the two loose ends of the rope 2 at vertex D are connected with an elastic rope 36 using at least one clamp 6. The vertex angle D is less than 90 degrees (acute). In other embodiments, the vertex angle D may be 90 degrees (right angle) or more than 90 degrees (obtuse). The other end of the elastic rope 36 is positioned between the two loose ends of the rope 2, effectively joining the two loose ends of rope 2 together with the elastic rope 36. The base EF of the triangle DEF is secured to the ground by attaching two loop 4 corresponding to base vertices E and F to the predetermined positions, using one of a plurality of anchors 30 per loop 4.

Triangle ABC has a midpoint 8 located on base AB. Triangle DEF has a midpoint 10 located on base EF. A pitcher's position of triangle ABC is located near the midpoint 8, outside of the perimeter of the triangle ABC (as shown in FIG. 2). While the pitcher's position of triangle DEF is located near the midpoint 10, outside of the perimeter of triangle DEF. The Beach Sniper game kit 100 also includes a first strike base 40 and a second strike base 38, both marked by at least one of the plurality of anchors 30. The first strike base 40 is located in a first region, which is as shown in FIG. 2 positioned above the elastic rope 36, while the second strike base 38 is located in a second region, which is positioned below the elastic rope 36. The first and second regions are divided by the elastic rope 36. The target ball support 12 is suitable to hold the target ball 20 in a predetermined position, located in between the left and right fields 102 and 104. The predetermined position is equidistant from both vertices C and D. The target ball support 12 has a square base 58 which has plurality of holes 14 located at its corners. In other embodiments, the base 58 may have other shapes. The square base 58 is secured unto the ground using at least one of the plurality of anchors 30 (as shown in FIG. 1A). The anchors 30 are staked through the plurality of holes 14 and keep the square base 58 at a static state.

Figure 3A:
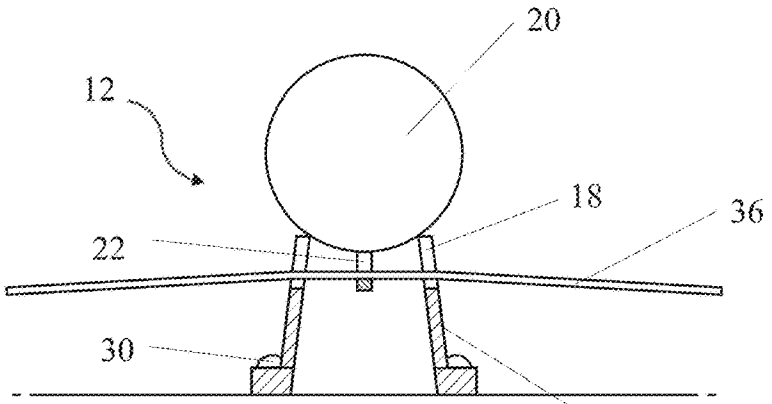
FIG. 3A shows a side cross-sectional view of a target ball support.

On top of base 58 is a hollow conical frustum 13, where the diameter of the upper end of the hollow conical frustum 13 is smaller compared to the lower end, with the diameter gradually increasing from the top to the lower end (as shown in FIGS. 1A, 1B, 3 and 3A). At the top of the hollow conical frustum 13 is a passing channel 18, when the target ball support 12 is secured in the predetermined position, the elastic rope 36 is guided into the passing channel 18, and the elastic rope 36 sits under the tension on the hollow conical frustum 13 (as shown in FIG. 1A, 1B, 3A). On top of the hollow conical frustum 13, the target ball 20 sits and is hooked to the midpoint 16 of the elastic rope 36 through a hook 22, which is located on target ball 20 (as shown in FIG. 3A). The midpoint 16 is located at the center of the elastic rope 36. The purpose of hook 22 is to come into contact with the elastic rope 36 in order to hold the target ball 20 in position when the target ball 20 is hit by either pitch ball 28 or strike ball 60.

Figure 4:
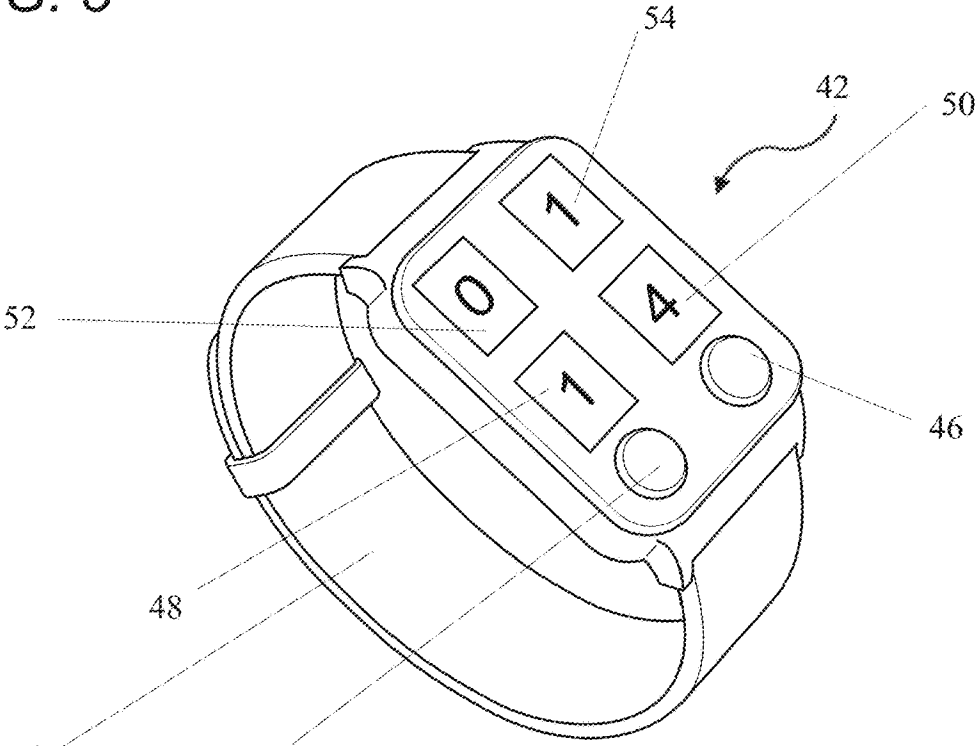
FIG. 4 shows an elevated right perspective view of a digital meter.

FIG. 4 exemplifies a left, elevated perspective view of a digital counter 42. The digital counter 42 has a strap 56 and is designed to be worn on a wrist of a player in order to track and display the score. The digital counter 42 is equipped with two buttons: the blue button 44 corresponds to one team and red button 46 corresponds to the other team. The colors of the buttons are assigned as red and blue for illustrative purposes only. Buttons of any other colors, shapes, or textures may be chosen based on design preferences or functional requirements. The digital counter 42 also includes two distinct pairs of windows. First pair of windows, blue score window 48 and red score window 50, displays the current points for each of the teams. The second pair of windows, blue game score window 52 and red game score window 54, displays score for the games for each of the teams. The digital counter 42 can be effectuated using either mechanical or electronic methods. In the electronic configuration, a microprocessor is employed to perform the counting and display functions. The mechanical method of counting may utilize widely known techniques, such as gear-and-dial systems, ratchet mechanisms, or stepping cams, where the movement of gears or levers incrementally advances the display of the score. These mechanical systems are typically triggered by the pressing of buttons and are capable of reliably recording and displaying scores without the need for electronic power. Additionally, a hybrid method may also be employed, synthesizing both mechanical and electronic components for increased reliability and versatility.

Rules of How to Play the Beach Sniper Game: The Beach Sniper game is designed to be played on various surfaces, such as on beach sand, parks, schools, or any open area suitable for recreational activities. The game involves two teams. As described above, the game requires a target ball 20, seated on the hollow conical frustum 13 and hooked to the elastic rope 36 at midpoint 16. Moreover, there are at least two balls, the pitch ball 28 and strike ball 60. The pitch ball 28 is for tossing the ball to a teammate, while the strike ball 60 is used by the other team to attempt to hit the pitch ball 28 in mid-air. In other embodiments, the game can also be played with additional balls. When played on a flat, solid surfaces like wooden floors or concrete, the plurality of anchors 30 can be substituted with tape or other affixing methods.

Each team is equipped with a digital counter 42 which includes a strap 56. One team uses a digital counter 42 with a blue strap, while the other team uses a digital counter 42 with a red strap. Each digital counter 42 is equipped with a blue button 44 and a red button 46. Pressing the blue button 44 records a point for one team in their blue score window 48, and pressing the red button 46 records a point for the other team in their red score window 50. Additionally, the digital counter 42 displays the overall game points in a dedicated blue game score window 52 and red game score window 54 for each team.

Figure 5:
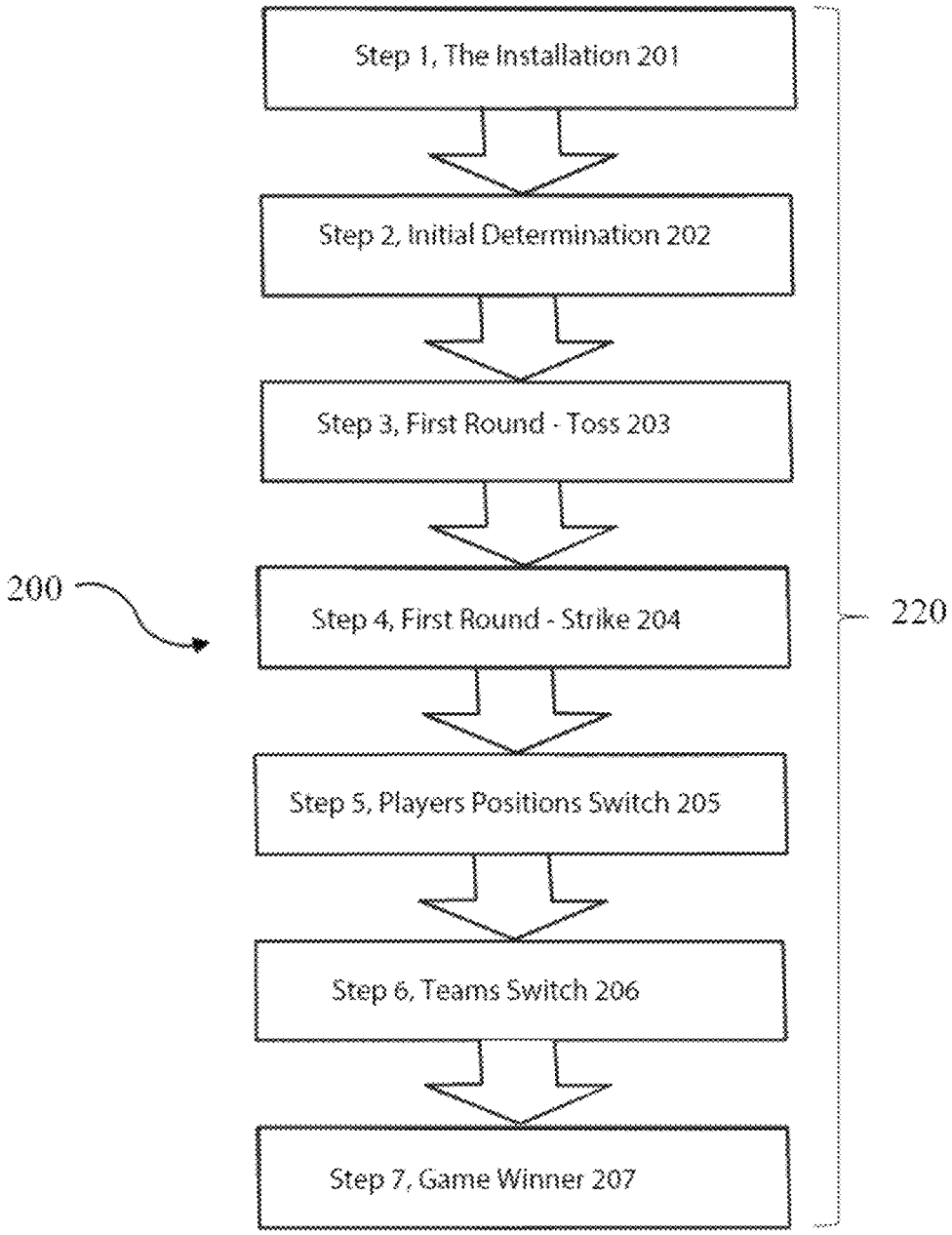
FIG. 5 shows a flow chart of method of use of an embodiment of the Beach Sniper game kit.

FIG. 5 exemplifies a flowchart 200 illustrating method of use 220 of the Beach Sniper game kit 100. As shown, method of use 220 comprise the steps of:

Step 1, The installation 201: The triangles ABC and DEF are laid on the playing surface, where they are positioned on opposite sides from one another. The triangles ABC and DEF are coupled together using the elastic rope 36, which in its turn is secured by using at least one clamp 6 (as described in paragraphs 0025 and 0026).

The target ball support 12 is positioned in between triangles ABC and DEF. The position of the target ball support 12 is in the middle of the elastic rope 36. The triangles ABC and DEF are secured to the playing surface using one of the plurality of anchors 30, wherein, each one of the plurality of anchors 30 is passed through the loops 4.

The target ball support 12 is anchored to the playing surface by using one of the plurality of anchors 30 that passes through each of the plurality of holes 14. A target ball 20 then is situated on the target ball support 12. The target ball 20 is positioned in a way that its hook 22 is placed inside the hollow conical frustum 13 of the target ball support 12. In this configuration, the hook 22 is retained by the elastic rope 36.

Figure 1C:
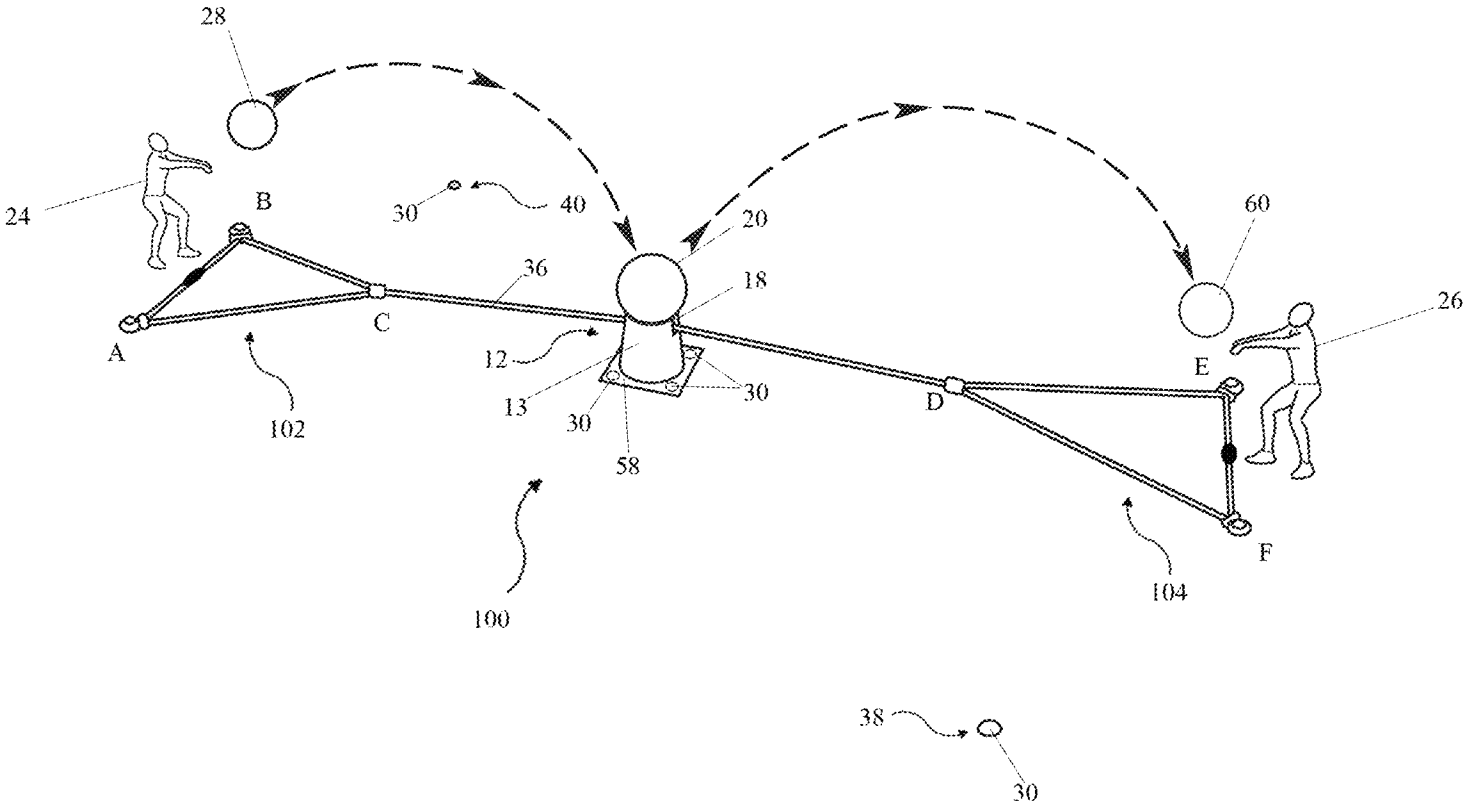
FIG. 1C shows an elevated right perspective view of an embodiment of the Beach Sniper game kit with the pitch ball and strike ball depicted in their respective trajectories.

Step 2, Initial Determination 202: To determine which team starts the game, one player from each team stands at their respective pitcher's position: one player from one team near the midpoint 8 of the base AB outside of the perimeter of the triangle ABC, and the other player from the other team near the midpoint 10 of the base EF, outside of the perimeter of the triangle DEF (as shown in FIG. 1C). Each player takes one consecutive turn attempting to hit the target ball 20 with their respective pitch ball 28 or strike ball 60, without crossing or touching their respective bases AB and EF, as doing so will result in no points being gained by the player and the other player takes the turn. The player who successfully hits the target ball 20, while the other player misses, wins the initial determination. If both players hit or both miss on their attempt, they continue taking alternating turns until one player hits the target ball 20 while the other misses, thus determining the winner. For illustrative purposes and throughout the remainder of the description, the team that wins the initial determination in Step 1, is thereafter referred to as the "starting team," and the other team is referred to as the "opposing team."

Step 3, First Round—Toss 203: For the first round, first player of the starting team 24 takes the pitcher's position near midpoint 8, outside the perimeter of the triangle ABC, more specifically along the line of the base AB (as shown in FIG. 2). The first player of the starting team 24 prepares to toss the pitch ball 28 to the second player of the starting team 26, wherein the second player of the starting team 26 is stationed at the receiver's position that is bound inside of the triangle DEF. The first player of the starting team 24 must ensure that he does not cross or touch the base AB during the throw, as doing so will result in no points being gained by the starting team. The second player of the starting team 26 may touch the sides of triangle DEF but must remain within the triangle DEF or the receiver's position; otherwise, catching the ball standing outside of that region does not earn the starting team any points.

a) If the toss of the first player of the starting team 24 is not caught by the second player of the starting team 26, no points are awarded.
b) If the toss of the first player of the starting team 24 is successfully caught by the second player of the starting team 26, the starting team earns one point.

Step 4, First Round—Strike 204: The first player of the opposing team 32, while holding the strike ball 60, stands with one foot on the second strike base 38 and prepares to strike the pitch ball 28 as soon as it is tossed by the first player of the starting team 24 and is still in the air. The first player of the starting team 24 may toss the pitch ball 28 only after the first player of the opposing team 32 signals his readiness to the first player of the starting team 24. Acceptable signals include a raised hand or a whistle. The second player of the opposing team 34, chooses a convenient position in the first region to try to catch the strike ball 60, in the mid-air, if it does not strike the pitch ball 28 as it is being tossed by the first player of the starting team 24.

a) If the first player of the opposing team 32 successfully strikes the pitch ball 28 in the air with the strike ball 60, the opposing team is awarded three points.
b) If the first player of the opposing team 32 does not strike the pitch ball 28, but the second player of the opposing team 34 catches the strike ball 60 in mid-air, the opposing team earns one point.
c) If neither the pitch ball 28 is struck by the strike ball 60 nor the strike ball 60 is caught, no points are awarded to the opposing team.

The awarded points may be different than as illustrated here.

The players repeat the process outlined in Steps 3 and 4 for a predetermined number of times. In this example, Steps 3 and 4 are taken one more time. Each team, after each round, records their result using their respective digital counter 42.

Step 5, Players Positions Switch 205: After completing the first round, all players switch positions. The first player of the starting team 24 moves inside the triangle ABC, at receiver's position, while his partner, the second player of the starting team 26 steps out of the triangle DEF and positions himself at the pitcher's position near the midpoint 10 of the base EF, outside the perimeter of the triangle DEF, more specifically along the line of the base EF, to make the next toss with pitch ball 28 in direction of the first player of the starting team 24. The first player of the opposing team 32 chooses a position in the second region suitable for him to catch the strike ball 60 as it is tossed by the second player of the opposing team 34 located in the first region, who throws the strike ball 60 with one foot placed on the first strike base 40.

With the new positions, players take predetermined number of rounds. In this example, two more rounds are played in the opposite direction, wherein the second player of the starting team 26 tosses the pitch ball 28 into direction of the first player of the starting team 24 and the second player of an opposing team 34 attempts to strike the pitch ball 28 in mid-air with the strike ball 60. The first player of an opposing team 32 attempts to catch the strike ball 60 in the air. Each team, after each round, records their result using their respective digital counter 42.

Step 6, Teams Switch 206: After the starting team has completed a predetermined number of tosses and the opposing team has completed a predetermined number of strikes, as described in Steps 3, 4, and 5, (in this example a total of four tosses and strikes), the teams switch roles. The opposing team now takes the position of the starting team as described in Step 3, while the starting team takes the opposing team's position as described in Step 4. After completing the first round of tosses and strikes (Steps 3-4) in these switched roles (in this example with two attempts), players of the teams are switching their respective positions as described in Step 5. The players of the opposing team switching the pitchers' and receiver's positions in their respective triangles, and the starting team players switching the positions inside the first region and the second region. Player of teams take predetermined number of rounds (in this example two more attempts) in opposite direction, as describe in Step 5.

The winner of the set is determined after a total number of tosses, in this example eight tosses. If the score is tied, the teams repeat the initial method of determining what team starts the game, Step 2, striking the target ball 20 with the balls to decide the winner.

Step 7, Game Winner 207: A team wins the game by winning two out of three sets, or three out of five sets, depending on the agreed match format. Other arrangements for determining the winner can be predetermined, such as winning five out of nine sets, or six out of eleven sets.

What is claimed is:

1. A beach sniper game, comprising:

a target ball;

a target ball support;

at least one strike ball;

at least one pitch ball;

at least one elastic rope; and at least two ropes, wherein each of the at least two ropes is folded into a shape of a triangle, wherein each of the base vertices of the triangles are shaped into a loop via at least one clamp.

2. The beach sniper game of claim 1, wherein each of the at least one clamp is attached at a sufficient distance from the base vertices to create the loop large enough to accommodate one of a plurality of anchors.

3. The beach sniper game of claim 1, wherein the vertex angle is less than 90 degrees.

4. The beach sniper game of claim 1, wherein each end of the at least one elastic rope is able to be coupled to loose ends of each of the at least two ropes via at least one clamp.

5. The beach sniper game of claim 1, wherein the length of the at least one elastic rope is adjustable based on the level of elasticity of the at least one elastic rope.

6. The beach sniper game of claim 1, wherein the target ball support is positioned in a predetermined position that bisects the at least one elastic rope.

7. The beach sniper game of claim 6, wherein the target ball support further comprises a hollow conical frustum positioned on a base.

8. The beach sniper game of claim 7, wherein the base has a square shape with holes located in each of the four corners of the base, where each hole can accommodate one of the plurality of anchors.

9. The beach sniper game of claim 7, further comprising a passing channel on top of the hollow conical frustum where the at least one elastic rope passes through.

10. The beach sniper game of claim 1, wherein the target ball has a hook attached to its outer surface.

11. The beach sniper game of claim 1, further comprising a digital counter having:

a first button with a first color corresponding to a starting team and a second button with a second color corresponding to an opposing team;

a first score window configured to display points for the starting team when the first button is pressed;

a second score window configured to display points for the opposing team when the second button is pressed;

a first game score window configured to display the overall game points for the starting team; and a second game score window configured to display the overall game points for the opposing team.

12. A method of using a beach sniper game for play by a plurality of teams, including the steps of:

positioning the beach sniper game upon a playing surface including the steps of:

laying on the playing surface two triangles positioned on opposite sides from one another, wherein the two triangles are coupled together through at least one elastic rope using at least one clamp;

setting a target ball support in between the two triangles, wherein position of the target ball support bisects the at least one elastic rope;

attaching each of the two triangles to the playing surface using one of plurality of anchors passing through each loop fashioned into the base vertices of each of the respective two triangles;

attaching the target ball support to the playing surface using one of the plurality of anchors passing through each hole located on a corner of a base of the target ball support; and situating a target ball on the target ball support in such a way that a hook of the target ball is positioned inside a conical frustum of the target ball support, whereby the hook comes into contact and is retained by the at least on elastic rope.

13. The method of using a beach sniper game for play by a plurality of teams of claim 12, further comprising the steps of determining which team starts the game first by:

a. positioning one player from each team at a pitcher's position, wherein the pitcher's position is located near a midpoint of a respective base of each of the two triangles and outside the perimeter of the corresponding each of the two triangles;

b. giving each player, located at the pitcher's position, an attempt to hit the target ball with their respective pitch ball or strike ball, without crossing or touching the base of one of the two triangles;

c. if any player crosses or touches the base of one of the two triangles, no successful hit is recorded and the other player takes the attempt;

d. declaring the team with the first successful hit, as a starting team and declaring the other team as an opposing team; and e. in case of a tie, continuing with additional single attempts per player until one team hits the target ball, while the other misses.

14. The method of using a beach sniper game for play by a plurality of teams of claim 13, further comprising the steps of first round to toss with steps of:

a. positioning a first player of the starting team at the pitcher's position of one of the two triangles;

b. positioning a second player of the starting team at a receiver's position in the other of the two triangles, wherein the receiver's position is located within the perimeter of the respective triangle;

c. having the first player of the starting team toss the pitch ball to the second player of the starting team, without the first player of the starting team crossing or touching the base of one of the two triangles;

d. awarding at least one point to the starting team when the first player of the starting team, during the toss of the pitch ball, does not cross or touch the base of one of the two triangles and the second player of the starting team successfully catches the pitch ball while remaining at the receiver's position; and e. recording scores using a digital counter after each round.

15. The method of using a beach sniper game for play by a plurality of teams of claim 14, further comprising the steps of first round to strike with steps of:

a. positioning a first player of the opposing team, within a second region with one foot positioned on a second strike base and with the strike ball at hand;

b. positioning a second player of the opposing team within a first region where a first strike base is located;

c. having the first player of an opposing team signal his readiness to the first player of the starting team and then attempting to strike the tossed pitch ball, using the strike ball;

d. awarding at least one point to the opposing team when the first player of the opposing team successfully strikes the pitch ball in mid-air;

e. awarding at least one point to the opposing team when the second player of the opposing team catches the strike ball in mid-air, when the first player of the opposing team does not strike the pitch ball in mid-air;

f. repeating the tossing and striking attempts for a predetermined number of rounds; and g. recording scores using the digital counter after each round.

16. The method of using a beach sniper game for play by a plurality of teams of claim 15, further comprising the steps of switching the players' positions after completing the predetermined number of rounds, wherein:

a. the first player of the starting team moves from the pitcher's position to the receiver's position within the same one of the two triangles, while the second player of the starting team moves from the receiver's position to the pitcher's position within the same one of the two triangles;

b. positioning the second player of the opposing team, within the first region with one foot positioned on the first strike base and with the strike ball at hand;

c. positioning a first player of the opposing team within the second region where a second strike base is located;

d. continuing playing the game for a predetermined number of rounds in the opposite direction, where the second player of the starting team tosses the pitch ball to the first player of the starting team and the second player of the opposing team attempts to strike the tossed pitch ball; and e. recording scores using the digital counter after each round.

17. The method of using a beach sniper game for play by a plurality of teams of claim 16, further comprising the steps of switching the teams' positions after completing the predetermined number of rounds, wherein:

a. switching the starting team's positions with the opposing team's positions and continuing playing the game for a predetermined number of rounds;

b. recording scores using the digital counter after each round;

c. determining the winner of the set after playing a predetermined number of rounds; and d. in case of a tie, repeating the steps of claim 15 until a team scores more points and is then declared the winner.

18. The method of using a beach sniper game for play by a plurality of teams of claim 17, wherein winning the beach sniper game is achieved by the team that first wins a predetermined number of sets.

* * * * *